US006484894B2

(12) United States Patent
Kiffmeyer et al.

(10) Patent No.: US 6,484,894 B2
(45) Date of Patent: Nov. 26, 2002

(54) MERCHANDISER DISPLAY FIXTURE

(75) Inventors: Ronald T. Kiffmeyer, Brainerd, MN (US); Michael L. McDonald, Blaine, MN (US)

(73) Assignee: Lindy Little Joe, Inc., Brainerd, MN (US)

( * ) Notice: Subject to any disclaimer, the term of this patent is extended or adjusted under 35 U.S.C. 154(b) by 0 days.

(21) Appl. No.: 10/164,878

(22) Filed: Jun. 7, 2002

(65) Prior Publication Data

US 2002/0148798 A1 Oct. 17, 2002

Related U.S. Application Data

(63) Continuation of application No. 09/409,303, filed on Sep. 29, 1999, now abandoned.
(60) Provisional application No. 60/102,631, filed on Oct. 1, 1998.

(51) Int. Cl.[7] ..... A47F 5/08
(52) U.S. Cl. ..... 211/126.1; 211/88.01; 211/103; 211/126.16

(58) Field of Search ..... 211/126.16, 126.12, 211/133.4, 126.2, 133.1, 103, 88.01, 126.1

(56) References Cited

U.S. PATENT DOCUMENTS

| | | | | | |
|---|---|---|---|---|---|
| 2,982,423 | A | * | 5/1961 | Handler et al. | 211/126.1 |
| 4,109,797 | A | * | 8/1978 | Brunette | 211/126.1 |
| 4,122,955 | A | * | 10/1978 | Celms | 211/126.1 |
| 4,552,272 | A | * | 11/1985 | Field | 211/88.01 |
| 6,070,841 | A | * | 6/2000 | Robinson | 211/59.1 |

* cited by examiner

*Primary Examiner*—Daniel P. Stodola
*Assistant Examiner*—Erica B. Harris
(74) *Attorney, Agent, or Firm*—Dorsey & Whitney LLP

(57) ABSTRACT

A merchandise display fixture for connection to an upright of a gondola display. The display fixture includes a cavity defined by a wall having front, rear, and side wall portions; and at least one mounting hook that extends from the rear portion of the wall. The display fixture is then mounted to a single upright of a gondola display such that the upright is located in a central location relative to the rear portion of the fixture.

27 Claims, 7 Drawing Sheets

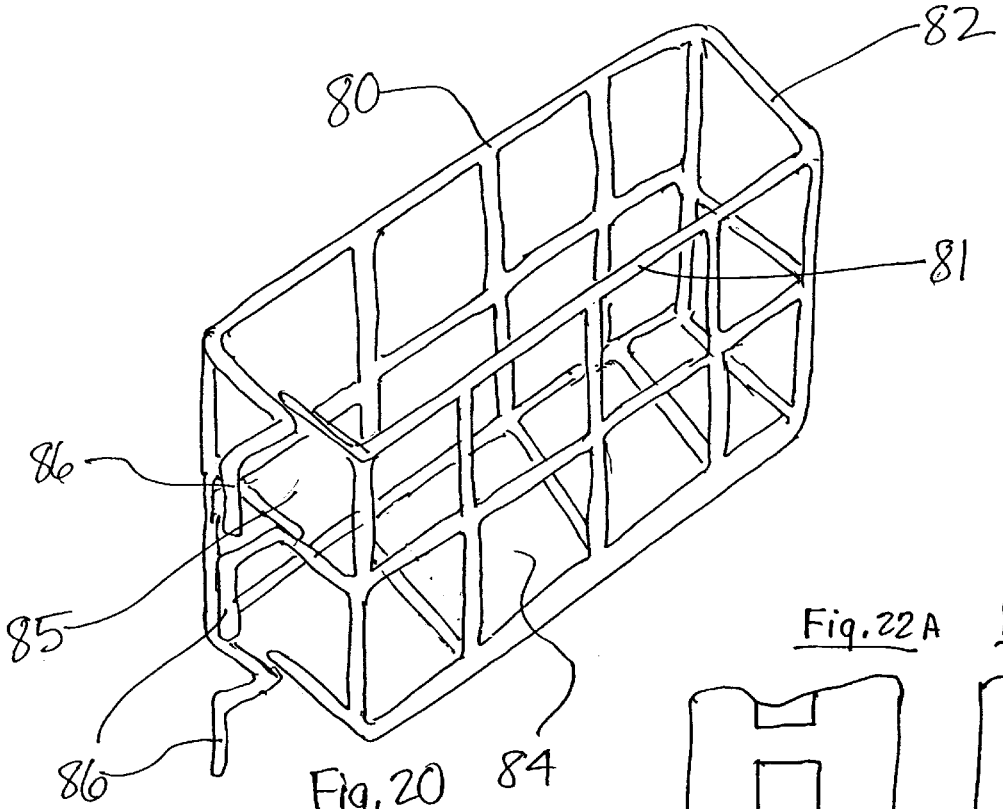
Fig. 20
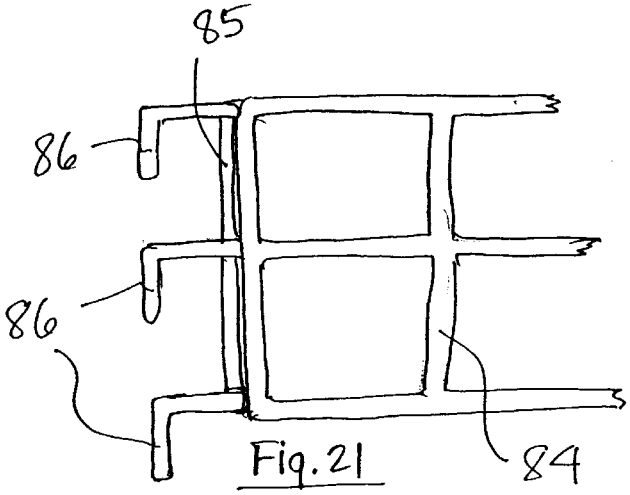
Fig. 21
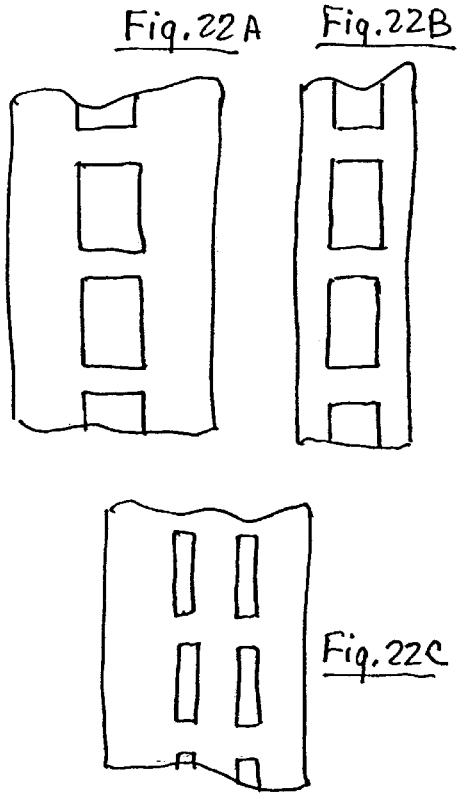

MERCHANDISER DISPLAY FIXTURE

PRIORITY CLAIM

This application is a continuation application of U.S. patent application Ser. No. 09/409,303, filed on Sep. 29, 1999, now abandoned, which claims the benefit of U.S. Provisional Application Ser. No. 60/102,631 filed Oct. 1, 1998.

BACKGROUND OF THE INVENTION

1. Field of the Art

The present invention relates generally to a merchandiser display fixture, and more particularly, to a merchandiser display fixture designed to facilitate use of what is currently wasted space on a retail store gondola display.

2. Description of the Prior Art

Merchandiser displays in retail stores are designed to allow an unobstructed view of the goods, easy removal and replacement of goods on the display and the capability of storing an inventory of goods on the display to limit the frequency of display restocking. Because retail product display space is extremely expensive, and at a premium, merchandisers and displays have been designed to utilize as much of the retail display space as possible. A common, and one of the most popular displays for retail establishments is commonly referred to as a gondola display.

A conventional gondola display unit includes a base and a vertically extending display board. The display board includes a plurality of display panels, each of which may include a series of holes similar to conventional pegboard for mounting product display hangers and the like for displaying product. A conventional gondola display is also provided with a plurality of gondola posts or uprights at the ends of the gondola structure and at spaced intervals between the ends. Commonly, these uprights are spaced every four feet. These uprights may be relatively narrow (about one inch) or up to two inches or so in width and extend the entire height of the structure. The uprights are provided with a series of elongated slots or openings or pairs of slots or openings, to receive brackets for the purpose of mounting shelves, product hangers or other display racks to the gondola display, if desired. Some of these holes or slots in the upright have a width sufficient to accommodate two shelf brackets to that they can support adjacent shelves at the same vertical level, while others include a pair of adjacent slots to also support two adjacent shelves. Thus, the upright holes are not designed or intended to support a product merchandiser or display device to a single upright.

The shelves in a gondola display unit commonly have one end connected to one upright and the other end connected to a laterally spaced upright so that the shelves, etc. span the display panel between the uprights. Still further, while shelves or other display baskets or bins are sometimes mounted to the gondola display, many times they are not. When shelves or the like are not utilized, the product is often mounted only to the panels by using product display hangers or the like. In these cases, one to two inches or more of space taken up by the gondola uprights is not utilized for retail display and is thus wasted. Even if shelves are utilized, a significant amount of the area taken up by the gondola upright, such as that between the vertically spaced shelves, often remains unused.

Accordingly, there is a need in the art for a merchandiser display fixture which is usable with merchandiser displays such as gondola displays and which utilizes what is commonly considered wasted space in the gondola display.

SUMMARY OF THE INVENTION

The merchandiser fixture of the present invention utilizes what is commonly wasted space on a retail store display such as a gondola display. Further, one embodiment comprises a single row of hooks to be connected with the vertical row of holes in a single upright, while a further embodiment comprises a plurality of vertically spaced hooks which are laterally staggered to accommodate the width of wider upright holes or laterally spaced pairs of upright holes, and thus provide stability to the merchandiser.

In contrast to the present invention, the merchandiser fixture of the present invention utilizes what is commonly wasted space on a retail store display such as a gondola display. Further, one embodiment comprises a single row of hooks to be connected with the vertical row of holes in a single upright, while a further embodiment comprises a plurality of vertically spaced hooks which are laterally staggered to accommodate the width of wider upright holes or laterally spaced pairs of upright holes, and thus provide stability to the merchandiser.

In general, the merchandiser display fixture in accordance with the present invention provides a product containing fixture which includes a product containing cavity or portion, a rearward end or a rear wall portion and one or more mounting hooks extending rearwardly from the rearward end for insertion and retaining engagement with a slot in the gondola upright of a gondola display. Preferably, the rear wall of the fixture of the present invention approximates the width of the gondola uprights and thus provides a display fixture which fully utilizes the normally wasted gondola upright space on a gondola display. Further, one embodiment comprises a single row of hooks to be connected with the vertical row of holes in a single upright, while a further embodiment comprises a plurality of vertically spaced hooks which are laterally staggered to accommodate the width of wider upright holes or laterally spaced pairs of upright holes, and thus provide stability to the merchandiser.

The preferred embodiment can comprise a rigid structural fixture or can comprise a structure constructed of plastic or the like which is formed from a single sheet or blank of material. It is also desirable and preferred for the rearward end of the fixture to be provided with at least two or more hook members which are aligned vertically and linearly to mate with vertically spaced openings in the gondola upright. Although the display in accordance with the present invention can be constructed of a variety of materials and be painted or given a variety of colors, a preferred display is constructed from a clear plastic material and is provided with a front wall to display product and pricing information or the like. The structure may also be constructed of wire form or the like with hooks (either constructed of wire or otherwise) extending from the rearward end.

The present invention also relates to a method of making the display fixture in accordance with the present invention which includes providing a sheet of plastic or other material from which the fixture is to be made and cutting out a blank or pattern for the fixture. Preferably, this blank includes a plurality of bottom, front, rear and side wall portions which when folded in a desired manner, form a product receiving cavity and a front wall and rear wall, with the rear wall being provided with one or more connection hooks for engagement with the gondola upright. Preferably, the back wall is formed utilizing a pair of back wall sections. One of these sections is provided with one or more elongated slots, while the other is provided with a corresponding one or more hook portions which extend through the slots for engagement with the gondola uprights.

A still further aspect of the present invention relates to the provision of a fixture blank or the like which can be folded and formed in accordance with the above process to provide the fixture of the present invention.

Accordingly, it is an object of the present invention to provide an improved merchandiser display fixture for use with a gondola display to eliminate generally wasted display space of the gondola uprights.

Another object of the present invention is to provide a display fixture for use with a gondola display which includes a product display cavity, a rearward end or wall, and one or more hook portions extending outwardly from the rearward end or wall for connection with a display structure such as a gondola display.

A further object of the present invention is to provide an improved method of making a merchandiser display fixture for connection with a gondola display.

A still further object of the present invention is to provide a product blank from which a merchandiser display fixture in accordance with the present invention can be made.

These and other objects of the present invention will become apparent with reference to the drawings, the description of the preferred embodiment and the appended claims.

DESCRIPTION OF THE DRAWINGS

FIG. 20 is an isometric view of a still further embodiment of the fixture in accordance with the present invention.

FIG. 21 is a fragmentary side elevational view of the rearward end of the fixture shown in FIG. 20.

FIGS. 22A, 22B and 22C are enlarged front elevational fragmentary views of portions of various gondola upright embodiments showing the plurality of vertically spaced holes or slots.

DESCRIPTION OF THE PREFERRED EMBODIMENT

Figure 1:
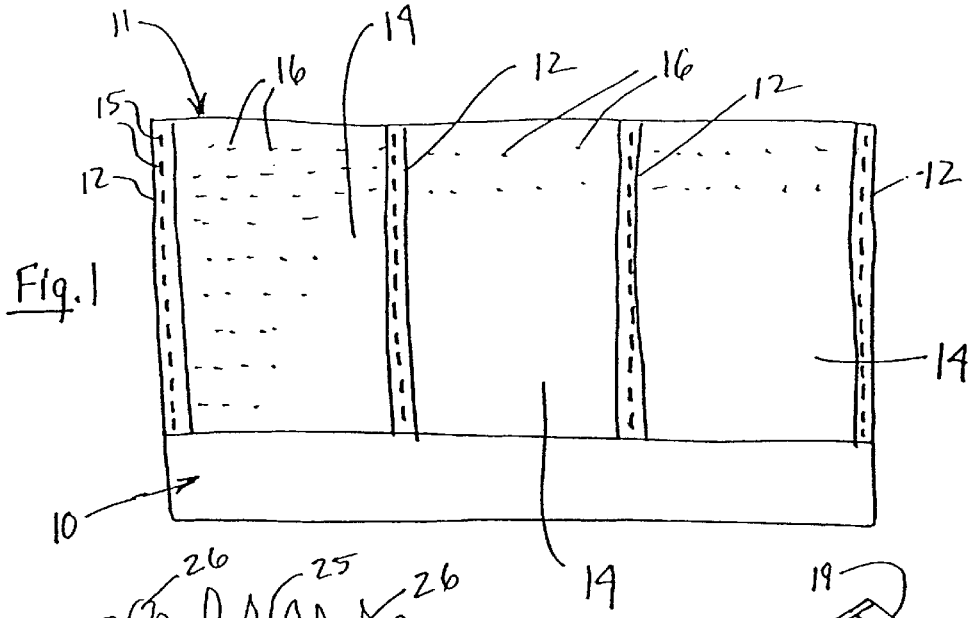
FIG. 1 is a front elevational view of a gondola display unit.

The present invention relates to a merchandiser display fixture which is designed for use with a conventional retail product display such as a display which is commonly referred to as a gondola display. As shown in FIG. 1, a conventional gondola display unit includes a base 10 designed to sit on the floor or other supporting structure and a vertically extending display board 11. The display board 11 includes a plurality of display panels 14 extending vertically from the base 10 and positioned in side by side relationship to one another. Each of the display panels 14 includes a series of holes 16 similar to conventional pegboard for mounting product display hangers and the like (not shown) for displaying product. It is contemplated that the display panels 14 could be provided with various mounting means other than the plurality of holes 16 without deviating from the benefits and advantages of the fixture in accordance with the present invention.

A conventional gondola display is also provided with a plurality of gondola uprights 12 positioned at the ends of the gondola structure and at spaced intervals between the ends. Conventionally, this spaced interval is four feet, although such spacing could be varied without deviating from the advantages of the present invention. Further, the uprights 12 could be uniformly spaced or could be variably spaced between the ends of the structure. It is common for several gondola units to be positioned in end to end relationship with one another. When this is done, the ends of the gondola bases 10 and the respective end gondola uprights 12 are positioned in side by side relationship to one another. Each of the gondola uprights 12 is provided with a plurality of elongated slots or holes 15 or other similar openings to receive shelf brackets for the purpose of mounting shelves to the gondola display if desired. The slots 15 in a particular gondola upright are generally uniformly and linearly spaced from one another throughout the entire height of the gondola display. As shown best in FIGS. 22A, 22B and 22C, the slots 15 in some uprights (FIGS. 22A and 22B) are quite wide relative to the thickness of hooks intended for insertion in the slots while in other uprights (FIG. 22C) the slots 15 are quite narrow and are often provided in laterally spaced pairs as shown. Generally, the slots 15 of FIGS. 22A and 22B can be up to ⅜ inch to ½ inch or more. In all cases, the slots 15 (whether they are single slots or pairs of slots) are linearly oriented relative to one another to form a vertical row or rows and are vertically spaced from one another.

Figure 2:
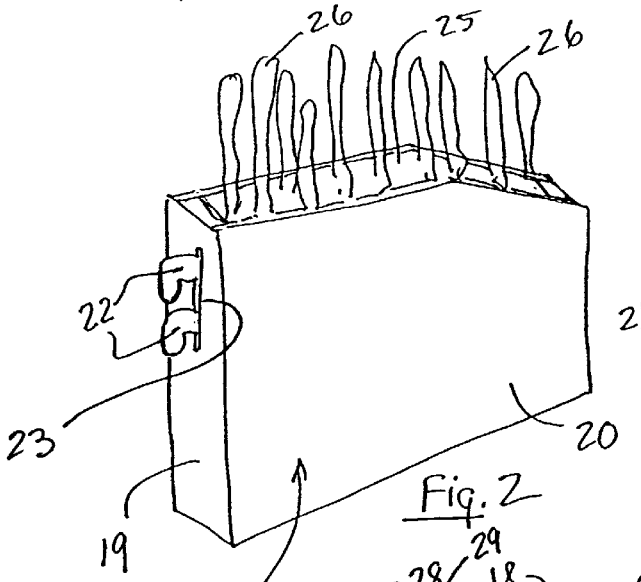
FIG. 2 is an isometric view of one embodiment of the fixture in accordance with the present invention showing the top, rear wall and one side wall of the fixture.
Figure 3:
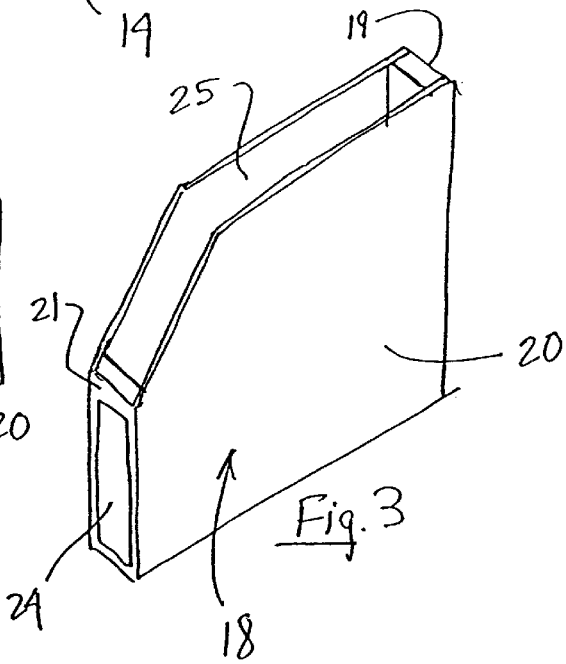
FIG. 3 is an isometric view of the fixture of FIG. 2 showing the top, front and other side wall of the fixture.
Figure 4:
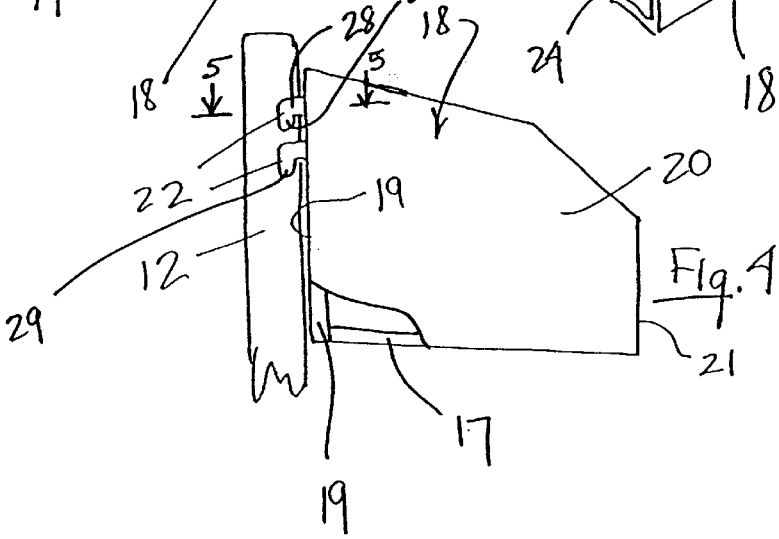
FIG. 4 is a view, partially in section showing the manner in which the fixture of the present invention mounts to the gondola display unit.

One embodiment of the fixture in accordance with the present invention is illustrated in FIGS. 2, 3 and 4. In general, the fixture is a narrow, box-like structure 18 having a rear or gondola facing wall 19, a pair of side walls 20, a front wall 21 and a bottom wall 17 (FIG. 4). As shown in FIG. 3, the front wall 21 may be provided with a label 24 or other display card or means to identify the merchandise or product in the fixture 18. The walls 17, 19, 20 and 21 define an interior merchandise receiving cavity 25 to receive and display merchandise 26 such as that shown in FIG. 2.

In the embodiment of FIGS. 2–4, the front, 21, rear 19 and bottom 17 walls are formed of a relatively thick, rigid and continuous material such as wood, plastic or other structurally rigid material. The side walls 20 are generally constructed of a relatively thin, structurally rigid and continuous material and secured to the side edges of the wall portions 17, 19 and 21 by conventional fastening means such as screws, nails, staples or adhesive. Although the embodiment of FIGS. 2–4 is shown as comprised of separate elements for each of the walls, it is contemplated that the structure of the fixture in FIGS. 2–4 could be a unitary, integral structural formed by a molding process or the like provided it includes a structure defining a merchandiser product cavity 25 and a rear wall 19 to support one or more male connection hooks 22. It is also contemplated that the structure 18 could be constructed of a variety of other materials including a wire construction. Such a structure would be relatively open so that the patent within the structure can be easily viewed.

As illustrated best in FIGS. 2 and 4, the rearward wall 19 is provided with a pair of male mounting or connection hooks 22 extending outwardly from the rear wall 19 at substantially right angles. In the preferred embodiment of FIGS. 2–4, the connection hooks 22 extend outwardly through an elongated slot 23 in the rear wall 19. Each of the connection hooks 22 is provided with a generally horizontally extending section 28 and a vertically extending section 29 to form the hook shaped element for connection with a corresponding slot 15 (FIG. 1) in a gondola upright. The hooks 22 can be supported relative to the rear wall 19 in a variety of ways providing the hooks 22 extend outwardly from the rear wall 19 at generally right angles. Further, although generally light weight fixtures may be provided with a single hook 22, it is preferred for the fixture 18 to be provided with at least a pair of hooks 22 which are spaced linearly and vertically along the rear wall 19 as shown. If the structure is constructed of wire or wire form, it is contemplated that the hooks 22 could be integrally joined with wire portions of the fixture as shown in FIG. 20 as an example, or could be connected to wire portions of the rearward end by welding or the like.

Figure 5:
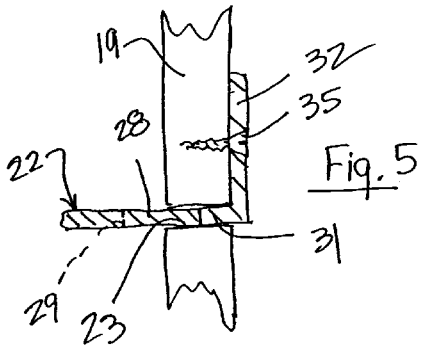
FIG. 5 is a view, partially in section, as viewed along the section line 5—5 of FIG. 4.
Figure 6:
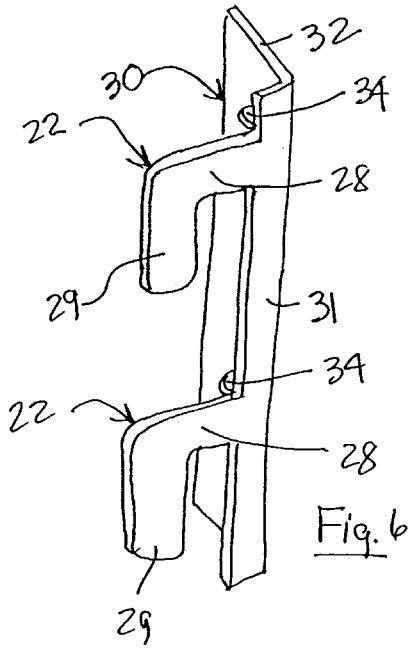
FIG. 6 is an isometric view of the hook connecting bracket for use with the fixture embodiment of FIGS. 2 and 3.

The means for connecting the hooks 22 to the rear wall 19 in the embodiment of FIGS. 2–4 is illustrated best in FIGS. 5 and 6. As shown in FIG. 6, each of the hooks 22 is integrally formed as part of a bracket comprising an angle member 30 with first and second legs 31 and 32. The legs 31 and 32 are integrally joined together at right angles and the leg 32 is provided with one or more connection holes 34. Integrally formed with and extending outwardly from an outer edge of the leg member 31 are the pair of hooks 22 with the laterally extending portion 28 integrally formed with the leg 31 as shown.

FIG. 5 illustrates the manner in which the bracket 30 is connected with the rear wall 19. Specifically, the hook members 22 and the leg 31 are inserted through the slot 23 in the rear wall 19 from the inside and the leg 32 is connected with an interior surface of the rear wall 19 by one or more screws 35.

The embodiment of FIGS. 2, 3 and 4 is shown as being constructed of wood or pressed board material; however, the fixture can be constructed of any desired material including cardboard, plastic or other materials such as wire. Further, it is contemplated that there are a variety of means that could be utilized for supporting the hooks 22 relative to the rear wall. Preferably, however, the material from which the bracket hooks 22 are constructed should be sufficiently strong and rigid to support the weight of the fixture 18 and the product 26 which it is intended to display. Although the structure 18 can be of varying sizes, it is preferred that the width (the distance between the side walls 20) be no greater than the width of the uprights 12. Thus, the fixture should be supported on a single gondola upright 12, with its connection hooks being connected with a single row of the upright slots 15.

Figure 7:
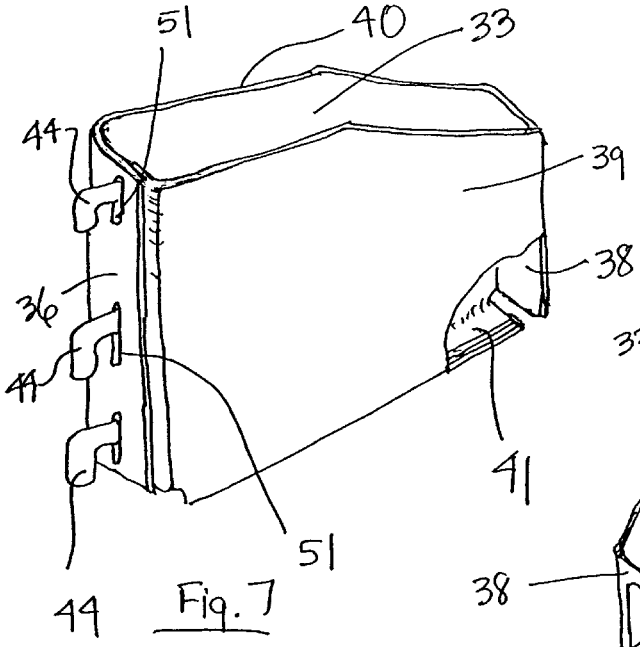
FIG. 7 is an isometric view similar to that of FIG. 2 of a second embodiment of a fixture in accordance with the present invention.
Figure 8:
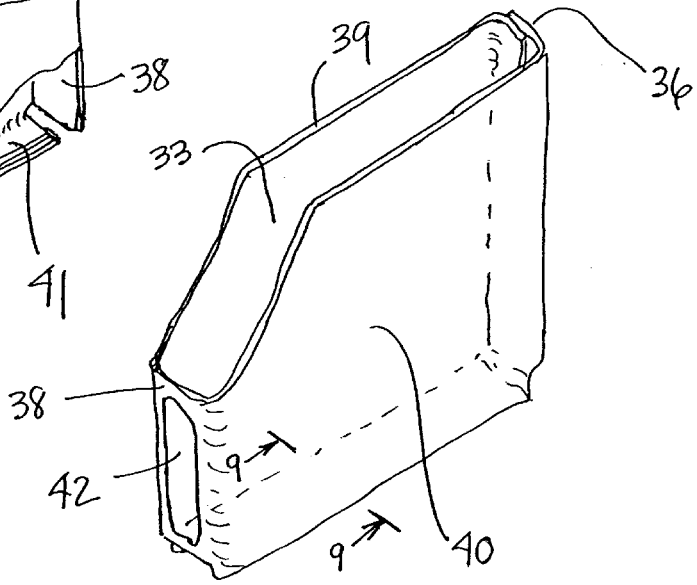
FIG. 8 is an isometric view of the fixture embodiment of FIG. 7 showing the top, front and one side wall of the fixture.

A second embodiment of the fixture in accordance with the present invention is illustrated in isometric views 7 and 8 and in sectional and elevational views 9–14. With reference to FIGS. 7 and 8, this embodiment of the fixture also includes a rear wall 36, a front wall 38, a pair of side walls 39 and 40 and a bottom wall 41. These walls together form the product receiving cavity 33. As shown, the side walls 39 and 40 extend between the rear wall 36 and the front wall 38 and the bottom wall 41 is connected with bottom edges of the walls 36, 38, 39 and 40. The front wall 38 may be provided with a product label 42 or the like to provide product and pricing information if desired. The rear wall 36 is provided with a plurality of hook shaped connection members 44 which extend outwardly from the rear wall 36 and are generally vertically and linearly aligned with one another as shown best in FIG. 7. As will be described in greater detail below, the embodiment of FIGS. 7 and 8 is formed from a single sheet of material and more specifically from a single product blank which is configured and folded to form the fixture of this embodiment.

Figure 9:
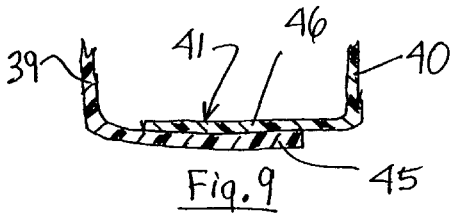
FIG. 9 is a sectional view of the bottom wall of the embodiment of FIGS. 5 and 6 as viewed along the section line 9—9 of FIG. 8.
Figure 10:
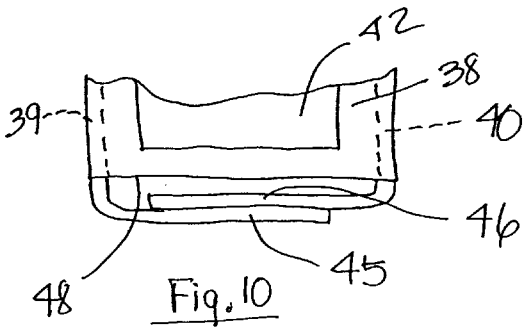
FIG. 10 is a front elevational fragmentary view of the fixture embodiment of FIGS. 7 and 8 showing the relationship between the front wall and the bottom wall.

In the preferred embodiment, as best illustrated in FIGS. 9 and 10, the bottom wall 41 is comprised of the bottom wall sections 45 and 46 which are integrally formed with the bottom edges of the side walls 39 and 40 respectively. Specifically, as shown, the bottom wall portions 45 and 46 are bent or folded inwardly at right angles to the side walls 39 and 40 so that they overlap one another to form the bottom wall 41. As shown best in FIG. 10, the front wall 38 is provided with a bottom edge 48 which, when formed into the fixture of the embodiment of FIGS. 7 and 8, is spaced above both the bottom wall sections 45 and 46. As shown in FIGS. 9 and 10, the bottom wall portion 45 is positioned below the bottom wall portion 46.

Figure 11:
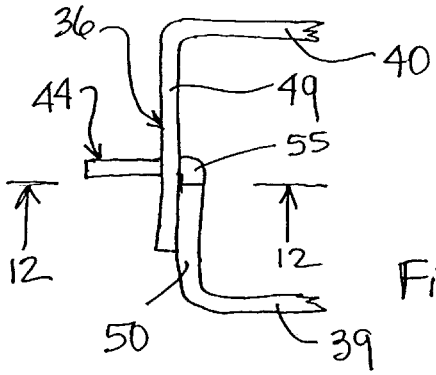
FIG. 11 is a top elevational fragmentary view showing the rear wall and portions of the side walls of the embodiment of FIGS. 7 and 8.
Figure 12:
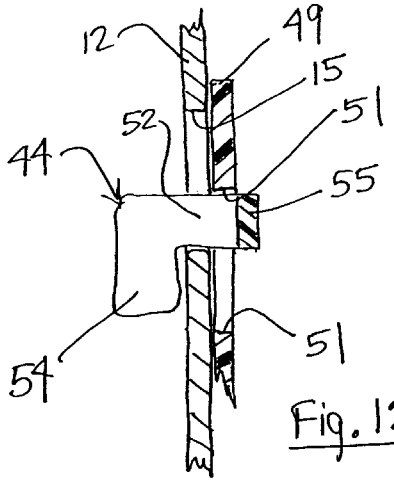
FIG. 12 is a view, partially in section, as viewed along the section line 12—12 of FIG. 11.
Figure 13:
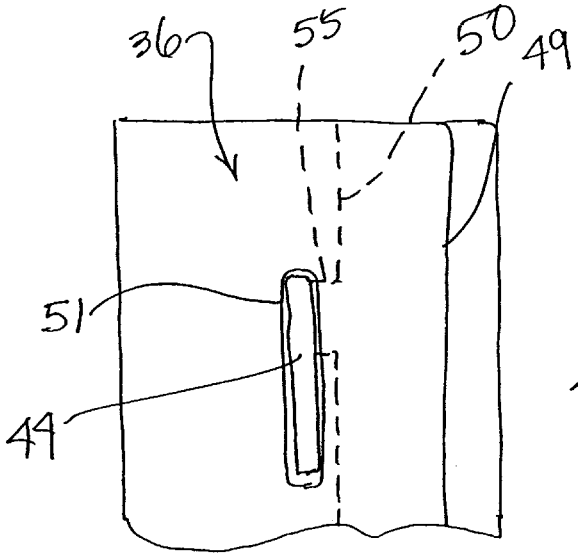
FIG. 13 is a rear elevational fragmentary view showing the rear wall and one of the connecting hooks of the fixture embodiment of FIGS. 7 and 8.

With general reference to FIGS. 7 and 8, and more specific reference to FIGS. 11, 12 and 13, the rear wall 36 is comprised of rear wall portions 49 and 50 which are integrally formed with and extend inwardly from the rear edges of the side walls 40 and 39, respectively. The rear wall portion 49 is provided with a plurality of elongated slots 51 to receive the plurality of hook members 44. As shown, each of the hook members 44 includes a generally horizontally or laterally extending portion 52 extending outwardly from the rear wall portion 50 at substantially right angles and a downwardly extending portion 54 integrally formed with the portion 52 as shown. These portions 52 and 54 define a hook member 44 which is designed for insertion into one of the slots 15 in a gondola upright 12 for connection thereto as shown. The inner end of the laterally extending portion 52 is integrally joined with a transition portion 55 which is in turn integrally formed with the rear wall portion 50.

Preferably the rear wall portion 49 in the embodiments of FIGS. 7 and 8 extends past the center line of the rear wall 36 as shown in FIG. 11 and the rear wall portion 50 extends approximately to the center line of the rear wall 36 so that the hook members 44, when the fixture is assembled, extend outwardly through the slots 51 approximately along the center line of the rear wall 36. The slots 51 are linearly positioned relative to one another approximately along the center line of the rear wall 36. As illustrated best in FIG. 13, the height of each of the slots 51 in a vertical direction is preferably greater than the overall height of the hook members 44 in a vertical direction so that the hook members 44 can be readily inserted through the slots 51. Also, for this same reason, the width of the slots 51 in a lateral or horizontal direction should be slightly greater than the width of the material from which the hook member 44 is constructed. Further, the upper end of the slots 51 defines a surface against which the upper surfaces of the hook portions 52 engage when the hook members 44 and thus the fixture is mounted to a gondola upright 12. Thus, the vertical position of the slots 51 should be designed so that in its fully assembled and operating position, the upper surface of the portion 52 will engage the upper edge of the slot 52 and the top edges of the sidewalls 39 and 40 will be at approximately the same height.

Figure 14:
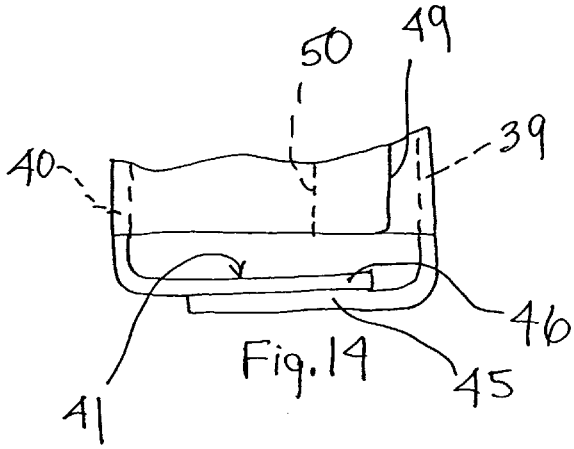
FIG. 14 is a rear elevational fragmentary view showing the bottom wall and a portion of the rear wall of the fixture of FIGS. 7 and 8.

As illustrated in FIG. 14, the bottom wall 41 is formed by bottom wall sections 45 and 46 similar to that illustrated in FIG. 10. Also as shown in FIG. 14 the bottom edge of the rear wall 36 and the bottom edges of the rear wall portions 49 and 50 are spaced above the bottom wall 41 and thus the bottom wall sections 45 and 46.

Figure 15:
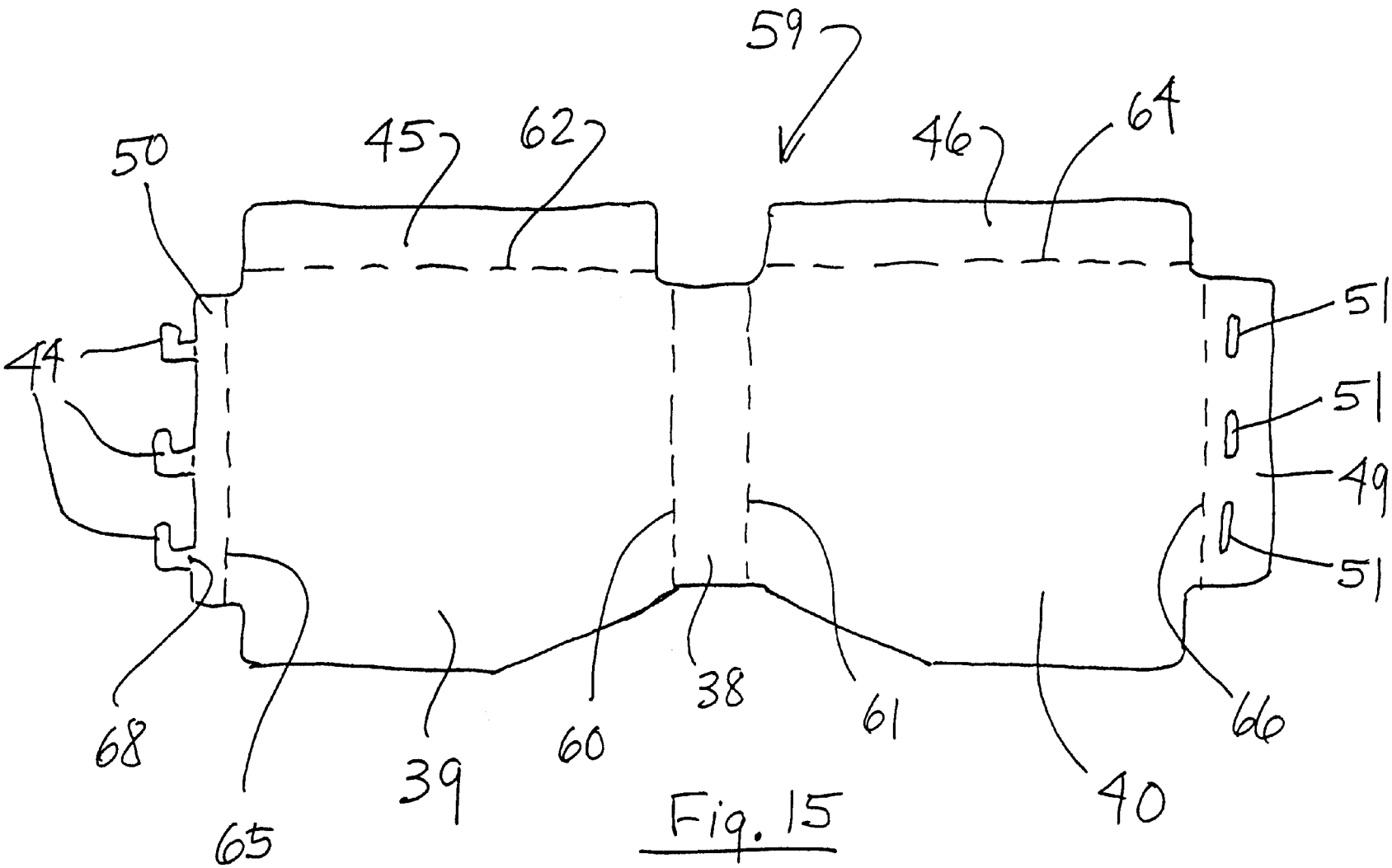
FIG. 15 is a fixture blank for the fixture embodiment of FIGS. 7 and 8.

FIG. 15 illustrates how the fixture embodiment of FIGS. 7 and 8 can be constructed from a single fixture or product blank 59. Specifically, the blank 59 can be cut out through any appropriate means from a single sheet of material from which the fixture is desired to be made. Preferably, the material is a plastic material such as clear or transparent PETG or other plastic such as acrylic or the like. The material should also preferably be strong and rigid enough to function in the manner in which the display fixture is intended to function and be capable of being bent and/or folded along various seams or fold lines as shown. Specifically, the blank as shown in FIG. 15 includes sections which define the front wall 38 and the side walls 39 and 40. The blank 59 also includes portions 45 and 46 which form the bottom wall sections 45 and 46 and ultimately the bottom wall 41. Still further, the blank 59 includes sections 49 and 50 which define the rear wall portions 49 and 50 and ultimately the rear wall 36. The portion 49 is provided with a plurality of slots 51 as shown and the portion 50 is provided with a plurality of outwardly extending hook portions 44 as shown. In FIG. 15, the entire blank 59 is a flat sheet of material. Thus, all of the portions of the structure as shown in FIG. 15 are generally planer.

The fixture blank 59 is provided with a pair of fold or bend lines 60 and 61 between the front wall panel 38 and the side wall panels 39 and 40. Fold lines 62 and 64 are also provided between the side wall panels 39 and 40 and their respective bottom wall panels 45 and 46 and fold lines 65 and 66 are provided between the side wall panels 39 and 40 and their respective rear wall panels 50 and 51. Still further, short fold or bend lines or regions 68 are provided between the rear wall panel 50 and the hook members 44.

Figure 16:
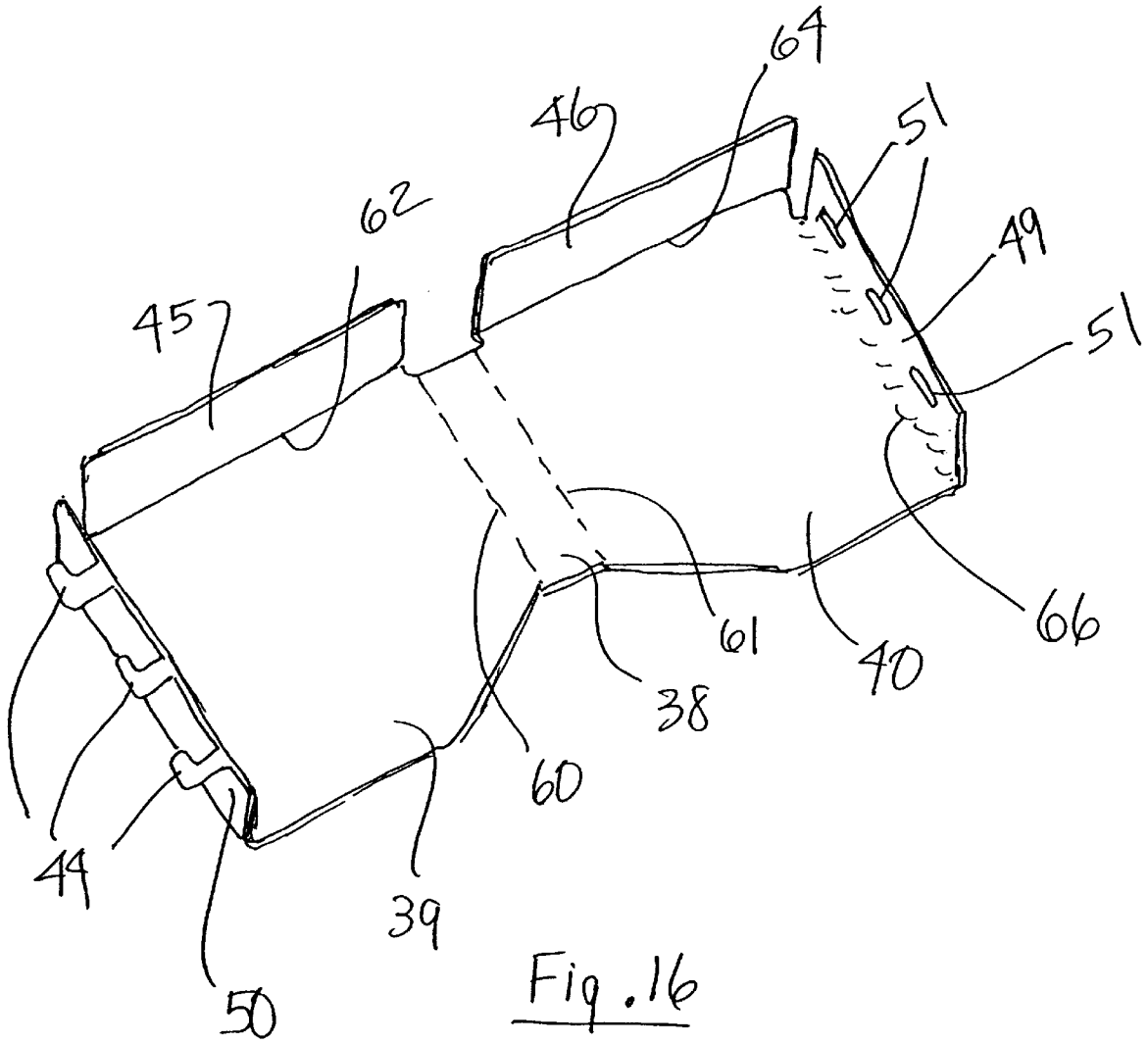
FIG. 16 is an isometric view of the product blank of FIG. 15 shown as partially formed into the fixture embodiment of FIGS. 7 and 8.

Reference is next made to FIG. 16 showing an intermediate stage in the process of making the fixture embodiment of FIGS. 7 and 8. As shown in FIG. 16, the bottom wall panels 45 and 46 are bent or folded at generally right angles to their respective sidewall panels 39 and 40 as shown. This is done via processes known in the art involving heating of the blank in the area where bending is desired. Further, the rear wall panels 49 and 51 are bent upwardly relative to their respective sidewall panels 40 and 39 and the hook members 44 are bent outwardly at right angles relative to the rear wall panel 50 along the bend lines 68. The result is the configuration illustrated in FIG. 16.

Next, the side wall panels 39 and 40 are bent inwardly along the fold lines 60 and 61 relative to the front wall panel 38. Finally, the entire structure is skewed slightly and the rear wall panels 49 and 50 pressed away from one another to permit the connection hooks 44 to be inserted into the slots 51 from the inner surface of the rear wall panel 49 and extend outwardly to the position illustrated in FIG. 7.

Figure 17:
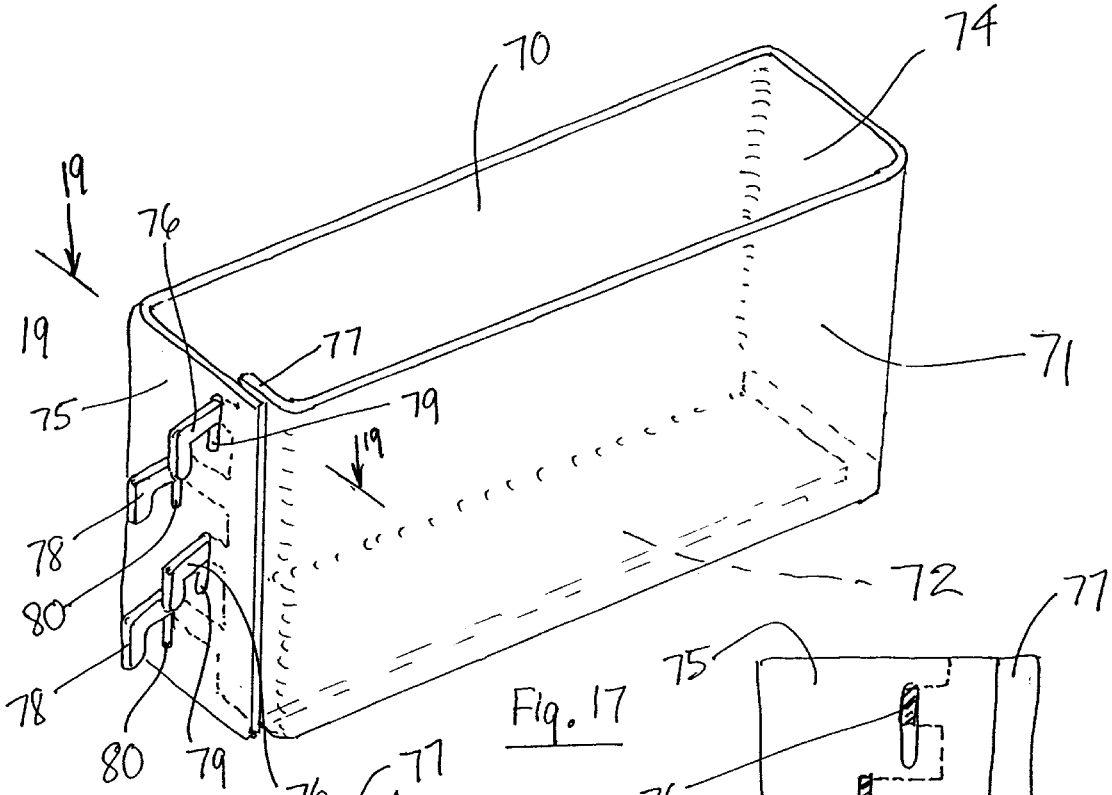
FIG. 17 is an isometric view of a further embodiment of a fixture in accordance with the present invention.

A further embodiment of the fixture in accordance with the present invention is shown in FIG. 17. Like the embodiment of FIG. 7, the embodiment of FIG. 17 is preferably constructed of a plastic material and is bent or folded along various bend lines to form the configuration shown. Specifically, the embodiment of FIG. 17 includes a pair of side walls 70, 71, a bottom wall 72, a front wall 74 and a rear wall 75 defining the rearward end of the fixture. A back wall portion 77 is integrally joined with the side wall 71 and is positioned adjacent to the rear wall 75.

Figure 18:
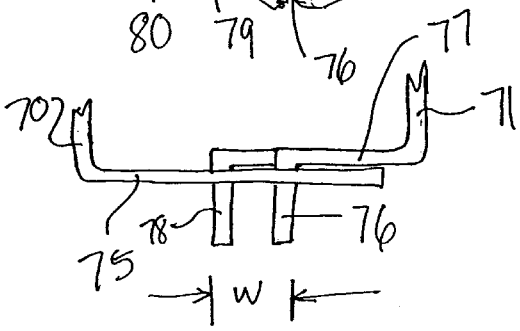
FIG. 18 is a top elevational fragmentary view of the rearward end of the fixture of FIG. 17.
Figure 19:
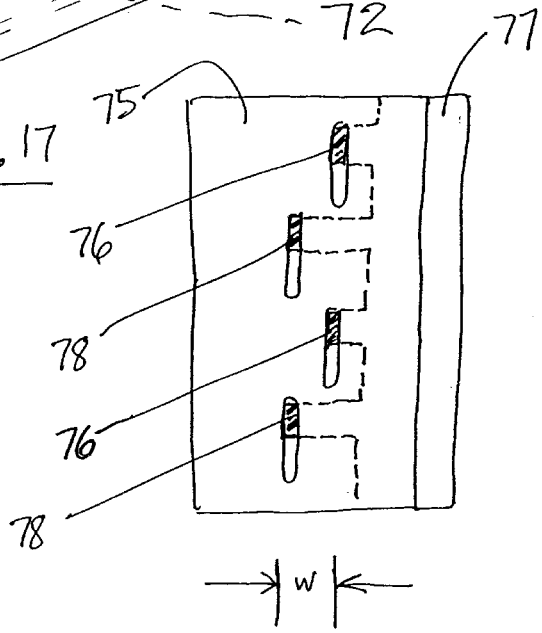
FIG. 19 is an elevational view of the rearward end of the fixture of FIG. 17 as cut along the line 19,19 of FIG. 17.

Extending outwardly from the rearward end are a first set of connection or mounting hooks 76 and a second set of connection or mounting hooks 78. As shown in FIGS. 17–19, the first set of connection hooks 76 are vertically aligned with one another and the second set of connection hooks are vertically aligned with one another; however, the first set of hooks 76 and the second set of hooks 78 are laterally offset from one another. The distance of this lateral offset is shown by the dimension "W" in FIGS. 18 and 19. This dimension "W" preferably approximates the width of the slots or holes 15 (FIGS. 22A and 22B) or the distance between the slots 15 in the embodiment of FIG. 22C. Accordingly, the offset configuration of the connection hooks provides improved stability to the fixture when it is supported in the upright slots 15 of a single upright 12. This is particularly the case where the width of the slot 15 is greater than the width of the connection hooks, such as would be the case for upright embodiments of FIGS. 22A and 22B. Preferably, the hooks in the embodiment of FIG. 17, are alternately laterally offset from one another as shown in FIGS. 17–19. However, it is possible to achieve the same stability benefit by having two laterally spaced hooks which are at the same vertical level for insertion into the upright slots 15 of any of the embodiments of FIGS. 22A, 22B or 22C. In such embodiment, like the embodiment of FIG. 17, the lateral spacing between the outer surfaces of the laterally spaced hooks would approximate the width of the wider upright slots 15 or the distance between a laterally spaced pair of narrower slots 15. In the embodiment of FIG. 17, the fixtures are formed from a single blank of plastic material like that of FIG. 7 and the connection hooks 76 and 78 extend through corresponding openings 79 and 80 in the wall portion 75.

A still further embodiment of a fixture in accordance with the present invention is shown in FIGS. 20 and 21. In this embodiment, the display structure is constructed of wire or wire form and includes a pair side walls 80 and 81, a front wall 82, a bottom wall 84 and a rear wall 85 defining a rearward end. Extending outwardly from the rearward end are a plurality of connection hooks 86. In the embodiment of FIG. 20, the connection hooks 86 are integrally formed with the wire from which the fixture is constructed; however, connection hooks could, if desired, be welded or otherwise connected to the rearward end of the fixture.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

What is claimed is:

1. A combination of a gondola display and a merchandiser display fixture removably mounted thereto comprising:

a gondola display base, a display panel extending upwardly from the base and at least two uprights extending upwardly from the base and positioned along the sides of the display panel, each upright being laterally spaced from one another with the display panel therebetween and including a plurality of upright slots spaced vertically along the uprights, and a display structure removably mounted to a single one of said at least two uprights, said display structure comprising:

a product receiving cavity defined by a wall having a rear wall portion parallel to said display panel and at least one mounting hook extending from said rear wall portion for selective connection to one of the upright slots in said single upright.

2. The combination of claim 1 wherein said wall further includes a front wall portion, a bottom wall portion and a pair of side wall portions and said display structure includes an open top.

3. The combination of claim 2 wherein each of said front, rear, bottom and sidewall portions substantially continuous.

4. The combination of claim 1 wherein said rear wall portion includes a top end and a bottom end and a vertical direction extending between said top and bottom ends and wherein said at least one mounting hook includes a pair of mounting hooks linearly spaced from one another in said vertical direction.

5. The combination of claim 1 including a pair of mounting hooks connected with said wall, said pair of mounting hooks being vertically spaced from one another and laterally offset from one another for selective connection to a pair of the elongated openings in said single upright.

6. The combination of claim 1 wherein said display structure is formed of wire.

7. The combination of claim 1 wherein a portion of said product receiving cavity is positioned on each lateral side of said mounting hook.

8. The combination of claim 1 wherein said display fixture, including said display structure and said at least one mounting hook, is constructed of a single continuous piece of plastic material.

9. The combination of claim 1 wherein said display structure, including said product receiving cavity, is fixedly connected with said at least one mounting hook.

10. The combination of claim 1 wherein said wall and said at least one mounting hook are rigidly and immovably connected with one another.

11. A merchandiser display fixture for selective connection to a gondola display of the type having a base, a display panel extending upwardly from the base and at least two uprights extending upwardly from the base and positioned along the sides of the display panel, each upright including a plurality of upright slots spaced vertically along the uprights, said merchandiser display fixture comprising:

a display structure having a rearward end for positioning adjacent to one of the uprights when the display fixture is connected to the one upright and a product receiving cavity and at least one mounting hook extending from said rearward end for selective connection to one of the upright slots wherein said display structure and said at least one mounting hook are formed from an integral piece of material and wherein said rearward end includes a first rear wall portion with a hole and a second rear wall portion with said mounting hook extending through said hole.

12. A combination of a gondola display and a merchandiser display removably mounted thereto, the combination comprising:

a base;

a display panel extending upwardly from said base;

at least a pair of uprights extending upwardly from said base and positioned along a side edge of said display panel, each of said uprights including a plurality of upright slots linearly spaced along said uprights and said uprights being laterally spaced from one another with said display panel positioned therebetween;

a display fixture removably attached to a single one of said pair of uprights, said display fixture comprising:

a display structure having a rear wall and side, front and bottom walls to define product receiving cavity, wherein said rear wall extends parallel to said display panel and at least one mounting hook extending outwardly from said rear wall for selective connection to one of said upright slots of said single one of said pair of uprights.

13. The combination of claim 12 wherein said rear wall includes a top end and a bottom end and a vertical direction extending between said top and bottom ends and wherein said at least one mounting hook further includes a pair of mounting hooks linearly spaced from one another in said vertical direction.

14. The combination of claim 13 wherein said pair of connection hooks are laterally offset from one another.

15. The combination of claim 12 wherein the width of the said display structure is no greater than the width of said upright.

16. The combination of claim 12 wherein a portion of said product receiving cavity is positioned on each lateral side of said mounting hook.

17. The combination of claim 12 wherein said display fixture, including said display structure and said at least one mounting hook, is constructed of a single continuous piece of plastic material.

18. The combination of claim 12 wherein said display structure, including said product receiving cavity, is fixedly connected with said at least one mounting hook.

19. The combination of claim 12 wherein said wall and said at least one mounting hook are rigidly and immovably connected with one another.

20. A merchandiser display fixture for selective connection to a single upright of a gondola display of the type having a base, a display panel extending upwardly from the base and at least two uprights extending upwardly from the base and positioned along the sides of the display panel, each upright being laterally spaced from one another with the display panel therebetween and including a plurality of upright slots spaced vertically along the uprights, said merchandiser display fixture comprising:

a display structure having a product receiving cavity defined by a wall and at least one mounting hook extending from said wall for selective connection to one of the upright slots in a single upright, wherein a portion of said product receiving cavity is positioned on each lateral side of said mounting hook and wherein said at least one mounting hook is centrally positioned relative to the lateral dimension of said receiving cavity.

21. A merchandiser display fixture for selective connection to a single upright of a gondola display of the type having a base, a display panel extending upwardly from the base and at least two uprights extending upwardly from the base and positioned along the sides of the display panel, each upright being laterally spaced from one another with the display panel therebetween and including a plurality of uprights slots spaced vertically along the uprights, said merchandiser display fixture comprising:

a display structure having a product receiving cavity defined by a wall and at least one mounting hook extending from said wall for selective connection to one of the upright slots in a said single upright, wherein said wall includes a hook opening and wherein said at least one mounting hook extends through said hook opening.

22. A merchandiser display comprising:

a base;

a display panel extending upwardly from said base;

at least a pair of uprights extending upwardly from said base and positioned along a side edge of said display panel, each of said uprights including a plurality of upright slots linearly spaced along said uprights and said uprights being laterally spaced from one another with said display panel positioned therebetween;

a display fixture for attachment to a single one of said pair of uprights, said display fixture comprising:

a display structure having a rear wall and side, front and bottom walls to define a product receiving cavity and at least one mounting hook extending outwardly from said rear wall for selective connection to one of said upright slots of said single one of said pair of uprights, wherein a portion of said product receiving cavity is positioned on each lateral side of said mounting hook and wherein said at least one mounting hook is centrally positioned relative to the lateral dimension of said receiving cavity.

23. A merchandiser display comprising:

a base;

a display panel extending upwardly from said base;

at least a pair of uprights extending upwardly from said base and positioned along a side edge of said display panel, each of said uprights including a plurality of upright slots linearly spaced along said uprights and said uprights being laterally spaced from one another with said display panel positioned therebetween;

a display fixture for attachment to a single one of said pair of uprights, said display fixture comprising:

a display structure having a rear wall and side, front and bottom walls to define a product receiving cavity and at least one mounting hook extending outwardly from said rear wall for selective connection to one of said upright slots of said single one of said pair of uprights, wherein said wall includes a hook opening and wherein said at least one mounting hook extends through said hook opening.

24. A combination of a gondola display and a merchandiser display fixture removably mounted to the gondola display, the combination comprising:

a gondola display base, a display panel extending upwardly from said base and at least two uprights extending upwardly from the base and positioned along the sides of the display panel, each upright being laterally spaced from one another and including a plurality of slots spaced vertically along said uprights; and a display structure removably mounted to a single one of said at least two uprights, said display structure comprising:

a product containing structure defining a product receiving cavity, said product containing structure having a rearward end parallel to said display panel and at least one mounting hook extending from said rearward end for selective connection to one of the slots in said single upright.

25. The combination of claim 24 wherein said product receiving cavity is defined by a substantially continuous, single piece of plastic.

26. The combination of claim 24 wherein said product receiving cavity includes a bottom, a forward end, a pair of sides and an open top.

27. The combination of claim 24 including at least two said mounting hooks for selective connection to corresponding slots in said single upright.

* * * * *

UNITED STATES PATENT AND TRADEMARK OFFICE

CERTIFICATE OF CORRECTION

PATENT NO. : 6,484,894 B2 
DATED : November 26, 2002
INVENTOR(S) : Ronald T. Kiffmeyer and Michael L. McDonald It is certified that error appears in the above-identified patent and that said Letters Patent is hereby corrected as shown below:

Column 2,
Please delete lines 11-20.

Column 9,
Line 28, please insert -- is -- between "portions" and "substantially"

Signed and Sealed this

Sixth Day of May, 2003

JAMES E. ROGAN
*Director of the United States Patent and Trademark Office*